US006081545A

United States Patent [19]

Sandor et al.

[11] Patent Number: 6,081,545

[45] Date of Patent: Jun. 27, 2000

[54] ARC FURNACE IMPROVED FUME COLLECTION

[75] Inventors: Louis Sandor, Barrington; Christopher Z. Sieradzki, Monee, both of Ill.

[73] Assignee: AMSTED Industries Incorporated, Chicago, Ill.

[21] Appl. No.: 09/157,699

[22] Filed: Sep. 21, 1998

[51] Int. Cl.[7] ..... F27D 17/00; F27D 23/00

[52] U.S. Cl. ..... 373/9; 373/2; 373/8; 373/78

[58] Field of Search ..... 373/9, 2, 8, 20, 373/68, 77–84, 43; 266/158, 159, 165; 110/201, 204, 345

[56] References Cited

U.S. PATENT DOCUMENTS

| | | | |
|---|---|---|---|
| 3,979,551 | 9/1976 | Overmyer et al. | 373/9 |
| 3,999,001 | 12/1976 | Overmyer et al. | 373/9 |
| 5,499,264 | 3/1996 | Schaller et al. | 373/78 |
| 5,541,952 | 7/1996 | Genge et al. | 373/9 |
| 5,905,752 | 5/1999 | Sieradzki et al. | 373/9 |

OTHER PUBLICATIONS

Chapter 18 from "The Making, Shaping and Treating of Steel", Ninth Edition, Edited by Harold E. McGannon, 1971.

*Primary Examiner*—Tu Ba Hoang
*Attorney, Agent, or Firm*—Edward J. Brosius; F. S. Gregorczyk; Stephen J. Manich

[57] ABSTRACT

An arc furnace fume collection system has a plurality of duct lines leading to a common duct that leads to a baghouse for filtering dust. The supplemental duct lines have high pressure fans, blowers, or compressors and join one of the other duct lines through a nozzle. The nozzle connection acts as a venturi to supplement the pulling power of a common exhaust fan downstream of the baghouse filter.

13 Claims, 1 Drawing Sheet

ARC FURNACE IMPROVED FUME COLLECTION

BACKGROUND OF THE INVENTION

1. Field of the Invention

The present invention relates to fume collection systems for use with electric arc furnaces in steel production.

2. Description of the Prior Art

Electric arc furnaces are commonly used in the production of steel products, such as in melting scrap metal for the casting of steel products. During the production of the molten steel, fumes are typically produced and emitted from several locations, such as at the arc furnace roof, at the arc furnace back door, at an intake pipe such as a pebble lime intake pipe, and at the arc furnace spout. For environmental control, fumes have typically been collected from at least one furnace area or collection point, such as at the furnace roof. A duct has been provided from the collection point leading to a baghouse where the exhaust stream was filtered. An exhaust fan or fans are provided downstream of the baghouse to draw fumes from the furnace through the duct and through the filters at the bag house.

To improve environmental control, such systems have been supplemented by collecting fumes from additional arc furnace areas or collection points. However, to add additional collection points can overload the original system if the exhaust from the supplemental collection points is simply introduced into an existing duct system, since the exhaust fan capacity will have been designed for a lesser load. One solution is to add supplemental baghouses with their own exhaust fans to collect fumes from the additional collection points. Another solution is to introduce the additional fumes into the original duct system and to replace the original exhaust fan or fans with higher capacity devices. However, neither of these solutions is satisfactory. To add additional baghouses is expensive and may result in an inefficient use of plant space. To replace an exhaust fan with a more powerful exhaust fan can be inefficient and more costly to operate. Typically, it is not necessary to draw fumes from each collection point at the same rate on a continual basis since the quantity of fumes emitted varies over the production cycle. A fan powerful enough to draw fumes from several areas at certain times may have excess capacity at other times in the production cycle. To use a fan with excess capacity throughout the production cycle wastes energy and can therefore be unduly expensive to operate.

SUMMARY OF THE INVENTION

The present invention provides an arc furnace fume collection system that draws fumes from more than one location and utilizes a single common baghouse while enabling the system to operate with an efficiently sized exhaust fan.

In one aspect the present invention provides an arc furnace fume collection system comprising at least one arc furnace, a common duct line having an end, and a bag house including a filter at the end of the common duct line. The system also includes at least one collecting duct line having an inlet and an end joining the common duct line to provide a flow path for fumes from said arc furnace through the collecting duct line and into the common duct line. The system also includes at least one supplemental duct line having an outlet end joining at least one of the common duct line and the collecting duct line and an inlet for fumes from said arc furnace. The system has a main air-moving device positioned to create a current of fumes from said arc furnace through the collecting duct line, through the common duct line, and through the filter in the bag house when the main air-moving device is operating. The system has a supplemental air-moving device positioned between the inlet and outlet end of the supplemental duct line and operable to push fumes toward the outlet end of the supplemental duct line. The inlet of the collecting duct line is positioned so that fumes from said arc furnace are drawn into the collecting duct line when the main air-moving device is operating. The inlet of the supplemental duct line is positioned so that fumes from said arc furnace are drawn into the supplemental duct line when the supplemental air-moving device is operating.

In another aspect, the present invention provides an arc furnace fume collection system comprising at least one arc furnace, a bag house including a filter and a common duct line leading to the filter. There is at least one collecting duct line that has an inlet and an end joining the common duct line to provide a flow path for fumes from said arc furnace through the collecting duct line and into the common duct line. There is at least one supplemental duct line that has a nozzle end joining at least one of the common duct line and the collecting duct line and an inlet. A main air-moving device is positioned to create a flow of fumes through the collecting duct line, the common duct line and through the filter when the main air-moving device is operating. A supplemental air-moving device is positioned between the inlet and the nozzle end of the supplemental duct line and is operable to push fumes through the nozzle end of the supplemental duct line. The inlet of the collecting duct line is positioned so that fumes are drawn from said arc furnace when the main air-moving device is operating. The inlet of the supplemental duct line is positioned so that fumes are drawn from said arc furnace when the supplemental air-moving device is operating. Pressure is reduced in at least one of the common duct line and collecting duct line upstream from the nozzle end of the supplemental duct line when the supplemental air-moving device is operating.

DETAILED DESCRIPTION

Figure 1:
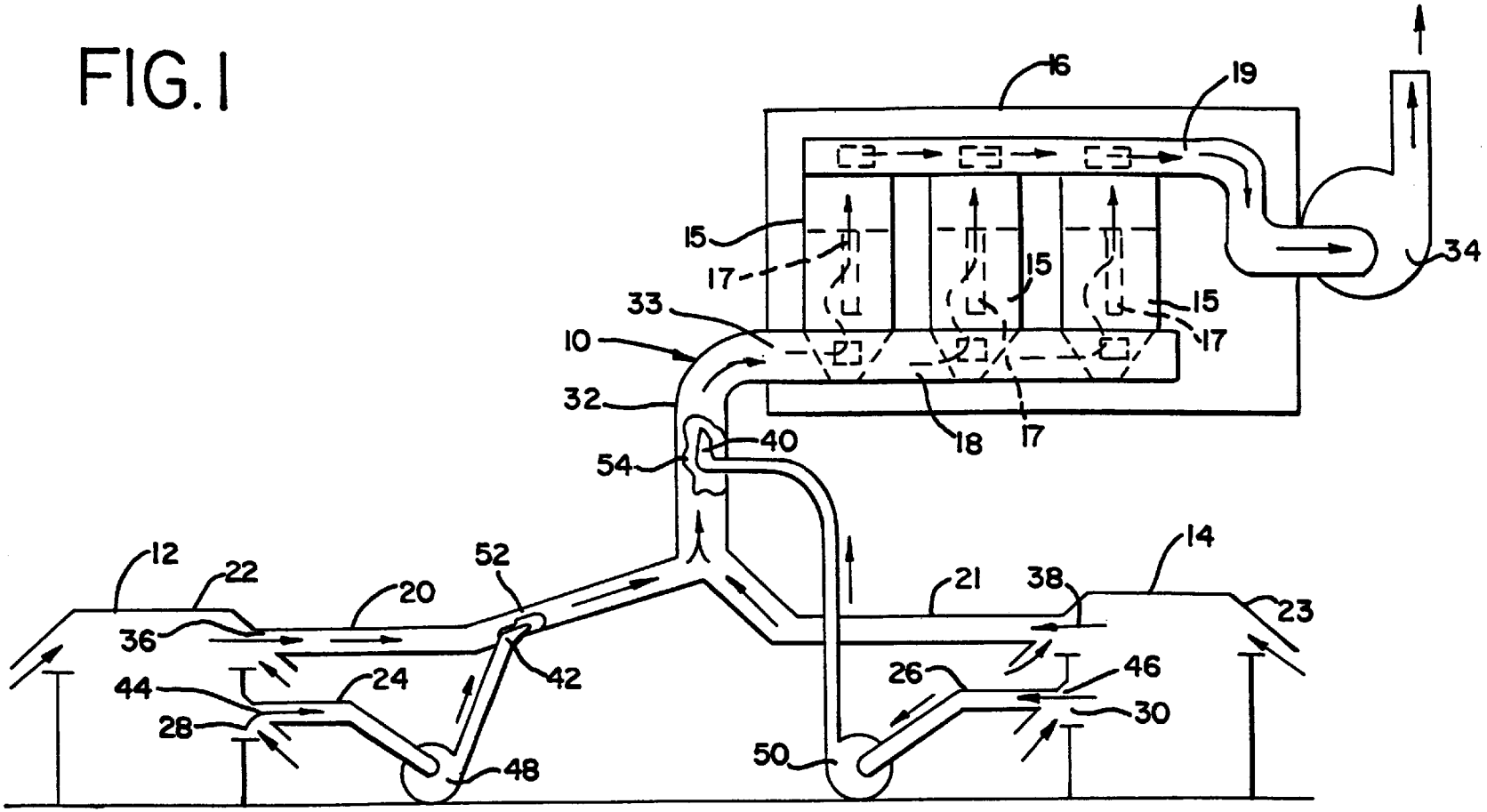
FIG. 1 is a simplified elevation of an arc furnace fume collection system incorporating the teachings of the present invention.

As shown in FIG. 1, the illustrated arc furnace improved fume collection system 10 has two electric arc furnaces 12, 14 serviced by a single baghouse 16. The electric arc furnaces 12, 14 may be of any standard type used in the steel industry. It should be understood that the present invention is not limited to systems with two furnaces: the invention may be applied to systems with single furnaces or with more than two furnaces serviced by a single baghouse.

The baghouse 16 may also be a standard baghouse, with a group of standard collector assemblies 15, each collector assembly 15 having standard filters 17. As shown in FIG. 1, each collector assembly 15 typically may have an inlet from an inlet manifold 18 or air supply duct and a plurality of filter bags serving as the filters 17. The filter bags are connected at their upper ends to an outlet manifold 19. Each collector compartment has a dust outlet at the bottom for removing dust that is filtered from the air for disposal or treatment. It should be understood that the simplified baghouse illustrated in FIG. 1 is provided for purposes of illustration only; any common filtering mechanisms may be used, and the invention is not limited to any particular type of filter or baghouse.

The arc furnace improved fume collection system 10 may draw fumes from a plurality of locations in the vicinity of each arc furnace 12, 14. For example, at each arc furnace 12, 14 as shown in FIG. 1, fumes may be drawn through a collecting duct line 20, 21 each having an opening at the roof 22, 23 of the electric arc furnace. Also as shown in FIG. 1, at each furnace 12, 14 fumes may also be drawn through an open end of a second or supplemental duct line 24, 26 positioned to draw fumes from parts of the arc furnaces separate from the parts from which the collecting duct lines 20, 21 draw fumes. As shown in FIG. 1, the supplemental duct openings may be positioned in the vicinity of the arc furnace back doors 28, 30, for example, to draw fumes when the back door is open for the foundry person to check on the state of the molten metal, to insert and operate a tool such as an oxygen torch in the crucible of the furnace, or for adding ingredients. Other locations may also or alternatively have additional duct lines positioned nearby for capturing exhausts, such as the pebble lime intake pipe, the openings in the furnace roof for the electrodes, or the furnace spout.

Also as shown in FIG. 1, the arc furnace fume collection system 10 also includes a common duct line 32 that leads to the inlet manifold 18 at the bag house 16 by means of the end connection 33. Thus, the common duct line 32 leads to the filters 17, that is, to the filter bags in the collectors 15.

As will be understood by those skilled in the art, the arc furnace fume collection system 10 also includes a main or common air-moving device 34 positioned to create or move a current of fumes mixed with air from the arc furnaces first through the collecting duct lines 20, 21, through the common duct line 32, and through the filters 17 in the baghouse 16. The common or main air-moving device 34 may be a standard exhaust fan positioned downstream of the filter, of standard size and operating characteristics for use with the collecting duct lines 20, 21 and common duct line 32 without the supplemental duct lines 24, 26. The size and type of fan may be selected based upon system parameters, using principles known in the art, as well as through consultation with someone skilled in the art of fan selection, implementation and operation, such as a fan supplier or manufacturer. The exhaust fan may be either a variable or constant speed fan, and it should be understood that the invention is not limited to any particular type of air-moving device.

One end of each of the collecting duct lines 20, 21 is connected to the common duct line 32 to provide flow paths for fumes collected at the arc furnaces 12, 14. The fume flow paths are from inlets 36, 38 in the collecting duct lines 20, 21 that are in the vicinity of part of each arc furnace, through the collecting duct lines 20, 21, into and through the common duct line 32, and into the collectors 15 in the baghouse 16 for filtering the fumes from the air through the filter bags 17. These fume flow paths are indicated by arrows in FIG. 1. In the illustrated embodiment, one outlet end 40 of one supplemental duct line 26 is also connected to the common duct line 32, although it should be understood that the outlet end of the supplemental duct line could instead be connected to the collecting duct line, as shown in FIG. 1 for outlet end 42 of supplemental duct line 24. In either case, a flow path is provided for fumes collected at one end 36, 38 of each supplemental duct line 24, 26. The fume flow paths are through an inlet 44, 46 in each of the supplemental duct lines 24, 26 in the vicinity of part of each arc furnace, through the supplemental duct line 24, 26, through the common duct line 32, and into the bag house 16 for filtering air from the fumes through the filter bags 17 in the collector compartments 15. These fume flow paths are indicated by arrows in FIG. 1. As illustrated in FIG. 1, the outlet end 40, 42 of each supplemental duct line that joins another duct line 20, 32 comprises a nozzle.

The inlets 36, 38, 44, 46 in either the collecting duct lines 20, 21 or supplemental duct lines 24, 26 may comprise hoods, openings in the duct lines, or any other suitable structure through which the fumes may enter into the duct lines.

A supplemental air-moving device 48, 50 is positioned in each supplemental duct line 24, 26 between the inlet 44, 46 and the nozzle end 40, 42 of the supplemental duct line 24, 26. The supplemental air-moving devices 48, 50 create currents of air and fumes in the supplemental duct lines 24, 26 that are pushed through the nozzles 40, 42 into one of the other duct lines 20, 32. In the illustrated embodiment, one nozzle 40 is connected to deliver high velocity streams of fumes mixed with air from one arc furnace 14 into the common duct line 32, and the other nozzle 42 is connected to deliver a high velocity stream of fumes mixed with air from the other arc furnace 12 into one of the duct lines 20.

Preferably, the supplemental air-moving devices 48, 50 comprises high pressure fans, blowers or compressors, although it should be understood that the present invention is not limited to any particular type of supplemental air-moving device. The fan may be a variable speed fan. The fan, blower or compressor may be selected based upon system parameters, using principles known in the art, as well as through consultation with those skilled in the art of fan, blower or compressor selection, implementation and operation, such as a supplier or manufacturer. Generally, at selected times, the supplemental fan, blower or compressor should provide sufficient pressure and velocity to create venturi effects at the junctions of the nozzles 40, 42 and the other duct lines 20, 32, without compromising operation of the other parts of the system, such as the main air-moving device 34.

The high pressure streams of air and fumes being pushed through the nozzles 40, 42 increase the downstream velocity while decreasing the upstream pressure which results in a boost of the air-collecting capability of the collecting ducts 20, 21. Thus, when each supplemental air-moving device 48, 50 is operating, the pressure in the other duct line 20 or 32 upstream from the junction with the nozzle 40, 42 is reduced, and the introduction of the flow from each supplemental duct line 24, 26 enhances the pulling effect of the main air-moving device or exhaust fan 34.

Providing such additional or supplemental collection lines 24, 26 with the second or supplemental air-moving devices 48, 50 is advantageous in several respects. First, it is not necessary to build or operate additional baghouses to add to the locations from which fumes are drawn. Second, the draw through existing duct lines 20, 21, 32 may be enhanced without changing the main or common exhaust fan 34. Third, the present invention allows particular areas of the furnace to be targeted for enhanced collection at particular times. For example, it may be desirable to operate each supplemental air-moving device 48, 50 at different or limited times during each production cycle, or it may be desirable to operate each supplemental air-moving device 48, 50 based upon some measured criteria. Thus, energy may be conserved, cutting costs and improving efficiency.

It should be understood that the principles of the present invention may be used for additional duct lines and additional areas targeted for fume collection. There may be a third, fourth or more supplemental duct lines, each with its own supplemental air-moving device, tied into a common or other duct line leading to a common baghouse. The system may also be combined with dampers to selectively close off the supplemental duct lines at times when it is desired to run the common exhaust fan alone, and to draw exhaust from a limited area of the arc furnace. It may be desirable to provide supplemental air-moving devices in each duct line leading to the common duct line, as well as in the common duct line itself. It may also be desirable to activate the supplemental air-moving devices 48, 50 to supplement the operation of the common or main air-moving device 34 at other times, even when it is not necessary to target the supplemental collection point for improved pick-up, but when an increased flow or draw is desired.

It may be desirable to combine the teachings of the present invention with those of U.S. patent application Ser. No. 08/680,145, to provide a smart system that selectively operates the supplemental air-moving devices 48, 50 or adjusts their speed or the speed of the main air-moving device 34 based upon pre-determined or measured criteria.

All of the duct lines 20, 21, 24, 26, 32 may be made of standard materials, such as steel, as known in the art. The nozzles 40, 42 may be made of the same material and may be sealed at the junctions 52, 54 with the receiving duct lines 20, 32 so that ambient air is not drawn into the receiving duct line at the junction.

It should be understood that the supplemental air-moving device and the nozzle should have characteristics that allow the fumes moving through the nozzle and into the joined duct line to create a pressure differential in one of the other duct lines to draw fumes from a point upstream of the nozzle. Characteristics for the nozzles 40, 42 and fans 34, 48, 50 may be selected based upon standard engineering practices.

While only a specific embodiment of the invention have been described and shown, it is apparent that various alternatives and modifications can be made thereto, and that parts of the invention may be used without using the entire invention. It is the intention in the appended claims to cover all such modifications and alternatives, and uses of parts of the invention, as may fall within the true scope of the invention.

We claim:

1. An arc furnace fume collection system comprising:

at least one arc furnace;

a common duct line having an end;

a bag house including a filter at the end of the common duct line;

at least one collecting duct line having an inlet and an end joining the common duct line to provide a flow path for fumes from said arc furnace through the collecting duct line and into the common duct line;

at least one supplemental duct line having an outlet end joining at least one of the common duct line and the collecting duct line and an inlet for fumes from said arc furnace;

a main air-moving device positioned to create a current of fumes from said arc furnace through the collecting duct line, through the common duct line, and through the filter in the bag house when the main air-moving device is operating; and a supplemental air-moving device positioned between the inlet and outlet end of the supplemental duct line and operable to push fumes toward the outlet end of the supplemental duct line;

wherein the inlet of the collecting duct line is positioned so that fumes from said arc furnace are drawn into the collecting duct line when the main air-moving device is operating, and wherein the inlet of the supplemental duct line is positioned so that fumes from said arc furnace are drawn into the supplemental duct line when the supplemental air-moving device is operating.

2. The arc furnace fume collection system of claim 1 wherein the outlet end of the supplemental duct line comprises a nozzle.

3. The arc furnace fume collection system of claim 1 wherein the main air-moving device comprises an exhaust fan positioned downstream of the filter to pull fumes through the common duct line and the filter.

4. The arc furnace fume collection system of claim 1 wherein the supplemental air-moving device comprises a high pressure fan.

5. The arc furnace fume collection system of claim 1 wherein the supplemental air-moving device comprises a blower.

6. The arc furnace fume collection system of claim 1 wherein the supplemental air-moving device comprises a compressor.

7. The arc furnace fume collection system of claim 1 wherein the supplemental duct line inlet is positioned to draw fumes from a part of said arc furnace separate from the part from which the collecting duct line inlet draws fumes.

8. An arc furnace fume collection system comprising:

at least one arc furnace;

a bag house including a filter;

a common duct line leading to the filter;

at least one collecting duct line having an inlet and an end joining the common duct line to provide a flow path for fumes from said arc furnace through the collecting duct line and into the common duct line;

at least one supplemental duct line having a nozzle end joining at least one of the common duct line and the collecting duct line and an inlet;

a main air-moving device positioned to create a flow of fumes through the collecting duct line, the common duct line and through the filter when the main air-moving device is operating;

a supplemental air-moving device positioned between the inlet and the nozzle end of the supplemental duct line and operable to push fumes through the nozzle end of the supplemental duct line;

wherein the inlet of the collecting duct line is positioned so that fumes are drawn from said arc furnace when the main air-moving device is operating;

wherein the inlet of the supplemental duct line is positioned so that fumes are drawn from said arc furnace when the supplemental air-moving device is operating; and wherein pressure is reduced in at least one of the common duct line and collecting duct line upstream from the nozzle end of the supplemental duct line when the supplemental air-moving device is operating.

9. The arc furnace fume collection system of claim 8 wherein the supplemental air-moving device comprises a high pressure fan.

10. The arc furnace fume collection system of claim 8 wherein the supplemental air-moving device comprises a blower.

11. The arc furnace fume collection system of claim 8 wherein the supplemental air-moving device comprises a compressor.

12. The arc furnace fume system of claim 8 wherein the main air-moving device comprises an exhaust fan positioned downstream of the filter to pull fumes through the collecting duct line, the common duct line and the filter.

13. The arc furnace fume collection system of claim 8 wherein the supplemental duct line inlet is positioned to draw fumes from a part of said arc furnace separate from the part from which the collecting duct line inlet draws fumes.

* * * * *